US006828520B2

(12) United States Patent
Galli

(10) Patent No.: US 6,828,520 B2
(45) Date of Patent: Dec. 7, 2004

(54) SELECTIVELY INSULATED DOME SWITCH CONFIGURATION

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 0 days.

(21) Appl. No.: 10/628,172

(22) Filed: Jul. 28, 2003

(65) Prior Publication Data

US 2004/0020755 A1 Feb. 5, 2004

Related U.S. Application Data

(62) Division of application No. 10/167,150, filed on Jun. 11, 2002, now Pat. No. 6,694,605.
(60) Provisional application No. 60/297,466, filed on Jun. 12, 2001.

(51) Int. Cl.[7] ..... H01H 5/18
(52) U.S. Cl. ..... 200/406; 200/512; 362/194
(58) Field of Search ..... 200/406, 512–517, 200/5 A, 5 R, 16 R, 203–206, 310–317; 362/186, 189, 194, 195; 29/622, 623

(56) References Cited

U.S. PATENT DOCUMENTS

| | | | | |
|---|---|---|---|---|
| 3,950,846 A | | 4/1976 | Johnson | 29/630 R |
| 4,005,293 A | | 1/1977 | Boulanger | 200/5 A |
| 4,033,030 A | | 7/1977 | Robinson et al. | 29/622 |
| 4,365,408 A | | 12/1982 | Ditzig | 29/622 |
| 4,843,197 A | | 6/1989 | Kojima et al. | 200/406 |
| 5,451,285 A | * | 9/1995 | Santo et al. | 200/516 |
| 5,778,507 A | | 7/1998 | Grannan et al. | 29/412 |
| 5,828,016 A | * | 10/1998 | Grannan et al. | 200/16 R |
| 5,924,555 A | | 7/1999 | Sadamori et al. | 200/512 |
| 6,073,341 A | | 6/2000 | Odorfer | 29/623 |
| 6,092,282 A | | 7/2000 | Roberts | 29/848 |
| 6,271,491 B1 | * | 8/2001 | Ono et al. | 200/520 |
| 6,333,477 B1 | * | 12/2001 | Koyama et al. | 200/513 |
| 6,522,147 B1 | * | 2/2003 | Pickard et al. | 200/314 |
| 6,552,287 B2 | * | 4/2003 | Janniere | 200/406 |

* cited by examiner

*Primary Examiner*—Elvin Enad
*Assistant Examiner*—M Fishman
(74) *Attorney, Agent, or Firm*—Barlow, Josephs & Holmes, Ltd.

(57) ABSTRACT

The present invention includes a new dome contact construction having an integral insulative layer that is precisely cut and aligned with the dome contact mechanism during fabrication. Prior to feeding the metal sheets or strips into the equipment for stamping and cutting the dome contact using the conventional method, a die cut layer of film is applied to one side of the sheet or strip. The film is cut into the shape of the desired insulative layer in the finished switch product and has periodic openings that correspond to the areas of the dome contact that are required to be uncovered both to provide electrical conductivity as a part of the proper function of the switch. The sheet of metal, including the laminate film, is cooled to a temperature near freezing to facilitate clean stamping of the laminated feedstock during the stamping process and is then fed into the forming and cutting press where the domes are formed and stamped.

12 Claims, 4 Drawing Sheets

SELECTIVELY INSULATED DOME SWITCH CONFIGURATION

PRIORITY CLAIM TO EARLIER FILED APPLICATION

This application is related to and claims priority from earlier filed provisional application No. 60/297,466, filed Jun. 12, 2001 and is a divisional of U.S. patent application Ser. No. 10/167,150, filed Jun. 11, 2002 now U.S. Pat. No. 6,694,605, the contents of which are incorporated herein by reference.

BACKGROUND OF THE INVENTION

The present invention relates to a selectively insulated dome switch that provides an integral insulative layer bonded to the switch during the manufacturing process, and to a method of manufacturing the same. More specifically, the present invention relates to a metallic dome switch having an integral layer of insulation bonded thereto with precisely located openings to allow proper operation of the switch.

Currently, dome switches are manufactured as follows: sheets or strips of thin metal, generally stainless steel, are fed through a press where the raised profile dome is first formed, and then the dome is stamped out of the carrier material to form a stand alone contact switch component. The dome switches produced using this method are all metallic and are completely conductive. To use a dome switch of this type in an electronic device, an additional layer of insulating material, such as an insulation disc or pad, must be installed under the dome switch to prevent unwanted electrical contact when the switch is in the normal convex resting position.

The difficulty that arises with the current state of the art is primarily related to integration of the switch with other components and insulation of the switch from the other components. To employ a dome switch, as described herein, a second layer of insulating material must be also installed in the device to isolate the switch from the other circuitry in the device. For example, in a flashlight application, a dome switch may be installed adjacent to a terminal of a coin type battery. In the normal resting state, the outer peripheral edges of the dome switch must be electrically isolated from the battery terminal to prevent the flow of electricity. This requires an insulated pad to be positioned between the switch and the battery terminal. However to allow actuation, a hole must be provided in the isolation material so that when the dome is depressed and inverted, the center of the dome can contact the battery terminal and close the circuit. This separate layer of insulating material thus increases manufacturing time and cost. In addition, because of the way the dome switch functions, the opening that is provided in the insulation material must accurately correspond to the center of the dome to allow only the center of the dome to make electrical contact with the battery when the dome is depressed. Therefore, the insulative layer must be properly aligned with the dome when installed to allow proper functioning of the switch.

Insulated dome switches have been known in the prior art. In this regard, it has been known to manually place domes on a magnetic fixture in orientation with each other and apply an adhesive backed laminate sheet, whereby the fixture establishes the spacing between and orientation of the domes as the sheet is applied. The term domes, sometimes called dome switches, as used in this application refers to domes having a convexo-concave shape and an outer periphery that may be circular, circular with a single flat tab, circular with a plurality of flat tabs, or otherwise shaped. More particularly, the domes referred to herein are metal and are stamped from a suitable metal strip and are also of a type that would require orientation. Further, the dome switches referred to herein generally include a layer of insulation that is applied during the manufacturing process to create a switch that functions properly in the device into which it is installed.

It is also known in the prior art to form laminated dome switches by stamping domes and inserting them in oriented fashion into pockets of a continuous tape. To maintain their orientation in the tape, a cover is placed on the tape and the assembled cover and tape is wound on a spool or reel. The assembly may be later removed for purposes of applying the domes into the finished product such as a keyboard. The laminate cover may be in the form of a releasable liner or strip of plastic that would maintain the domes in place in the pockets. This type of a system is called a pocket-tape system.

It has also been known to make a continuous strip of domes by stamping the domes one at a time using a punch press or stamping machine and directly applying the domes to the adhesive side of a dome seal. Thereafter, the domes are covered with a backup strip or release liner before being wound on a reel. Additionally, these single domes may be arranged for individual removal from the backup strip by kiss-cutting the dome seal.

In all of the prior art dome switches, the laminate is applied to one side of the dome and the other side is left exposed. In this manner, the exposed metallic side of the dome is used for electrical contact. In prior art applications, the peripheral edge of the dome generally sits on one electrical contact point and a second contact point is located centrally beneath the dome. When the dome is compressed, the center of the dome makes contact with second central contact point thus energizing the circuit. With the advent of a demand for greater efficiency, lower cost and smaller components in electronics packages, there is a demand for a dome switch that has an integrally formed insulative layer that selectively controls the contact points of the switch thereby eliminating the need for installing a separate insulative component.

SUMMARY OF THE INVENTION

The present invention provides for a unique and novel dome switch construction that includes an integral insulative layer that is precisely cut and aligned with the dome switch mechanism during fabrication. In this manner, the additional assembly step previously required for placement of the insulative layer is eliminated, while also reducing the potential for malfunctions due to improper alignment between the switch and the insulating material. Prior to feeding the metal sheet stock or strip stock into the equipment for stamping, a die cut layer of film is applied to one side of the sheet or strip. The film is precut into the shape of the desired insulative layer in the finished switch product. The film may be formed from a variety of materials known in the art to have insulating properties such as Mylar or elastomeric rubber and may take the form of a tape with preapplied adhesive or a sheet to which an adhesive is applied prior to laminating with the metallic switch stock.

Prior to lamination with the metallic switch feed stock, the film material is die cut so as to have both index markings and periodic openings that correspond to the areas of the dome switch that are required to be uncovered both to provide electrical conductivity as a part of the proper function of the switch and in the areas of waste around the periphery of the switch to be stamped. The metallic feed stock also has index markings for alignment of the film layer with the metal stock and registration of the laminated material in the stamping machine. This registration is necessary to insure that when the dome switches are stamped from the laminated material the periodic openings in the film fall in the proper locations on the finished product. The sheet of metal including the laminate film is then cooled to a temperature near freezing to facilitate clean stamping of the laminated feedstock during the stamping process and is then fed into the forming and cutting press. The step of cooling the sheet is an important aspect of the present invention in that it prevents the film layer and adhesive from adhering to the cutting dies and gumming up the equipment. When feeding the laminated and cooled stock into the press, the stock is aligned using the registration marks and the dome is formed and then cut out of the carrier material.

It is therefore an object of the present invention to provide an improved integrally insulated dome switch having precise operational alignment while eliminating additional assembly steps and potential human assembly errors from the finished product. It is also an object of the present invention to provide a dome switch for use in electronic devices that eliminates the need for additional insulative components thereby reducing the space required for the overall assembly. It is still a further object of the present invention to provide a method of manufacturing a dome switch with an improved integrally formed selective insulation layer.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
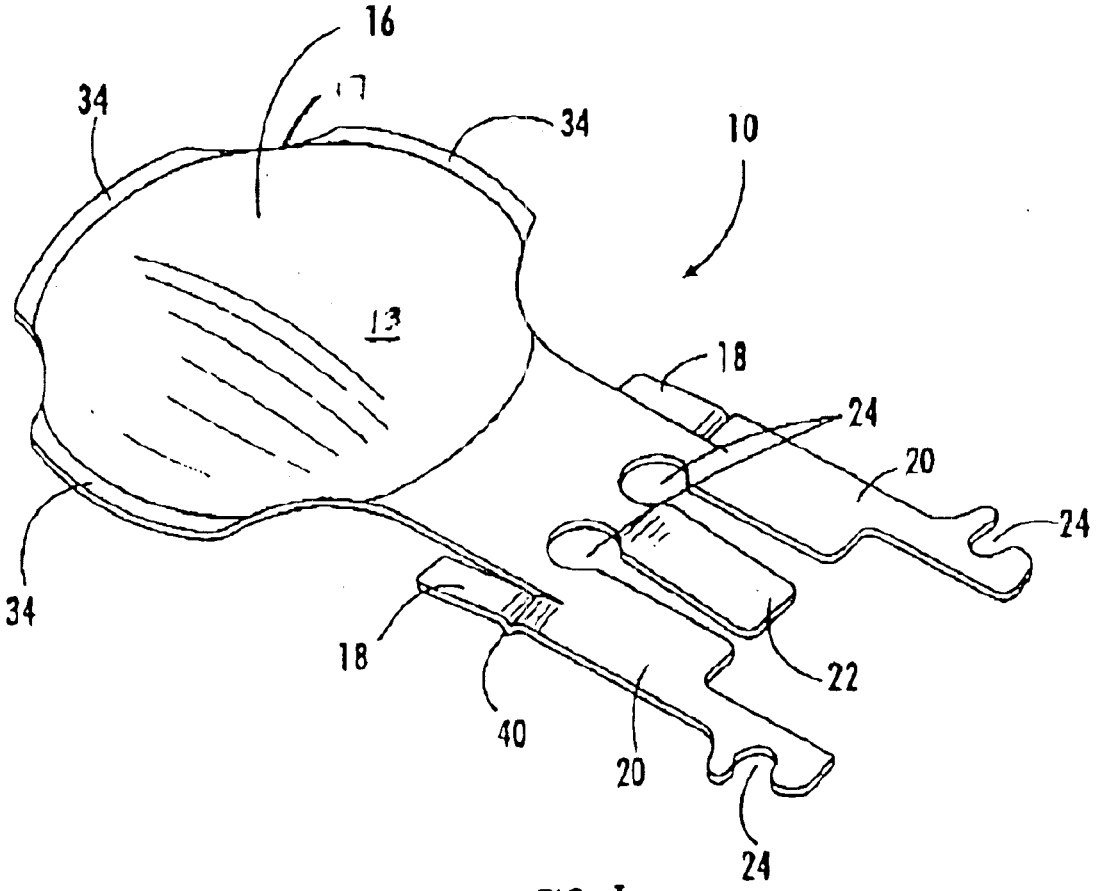
FIG. 1 is a perspective view of the top of the selectively insulated dome switch of the present invention.

Referring now to the drawings, the selectively insulated dome switch of the present invention is illustrated and generally indicated at 10 in FIGS. 1–4. As will hereinafter be more fully described, the present invention provides a dome contact 10 assembly with an integral insulation layer 12 that is applied so as to selectively isolate portions of the contact 10 from the other electrical components within the finished assembly. Further, the present invention provides a method of manufacturing a selectively insulated dome contact 10 where the insulative layer 12 is selectively applied to the raw stock material 14 in registration thereto and thereafter the selectively insulated stock material 14 is stamped to form the dome contact 10 to produce to provide a useful, novel and improved compact switching mechanism.

The present invention as shown in FIGS. 1–4 depict a specifics dome contact 10 configuration that is customized for use in a particular flashlight. While a particular configuration is shown herein as the preferred embodiment, it should be evident that the structure and method described is intended to encompass a broad range of dome type switches and is not limited to the specifically illustrated shape. For example, in its simplest form the contact 10 may only comprise the dome.

Figure 2:
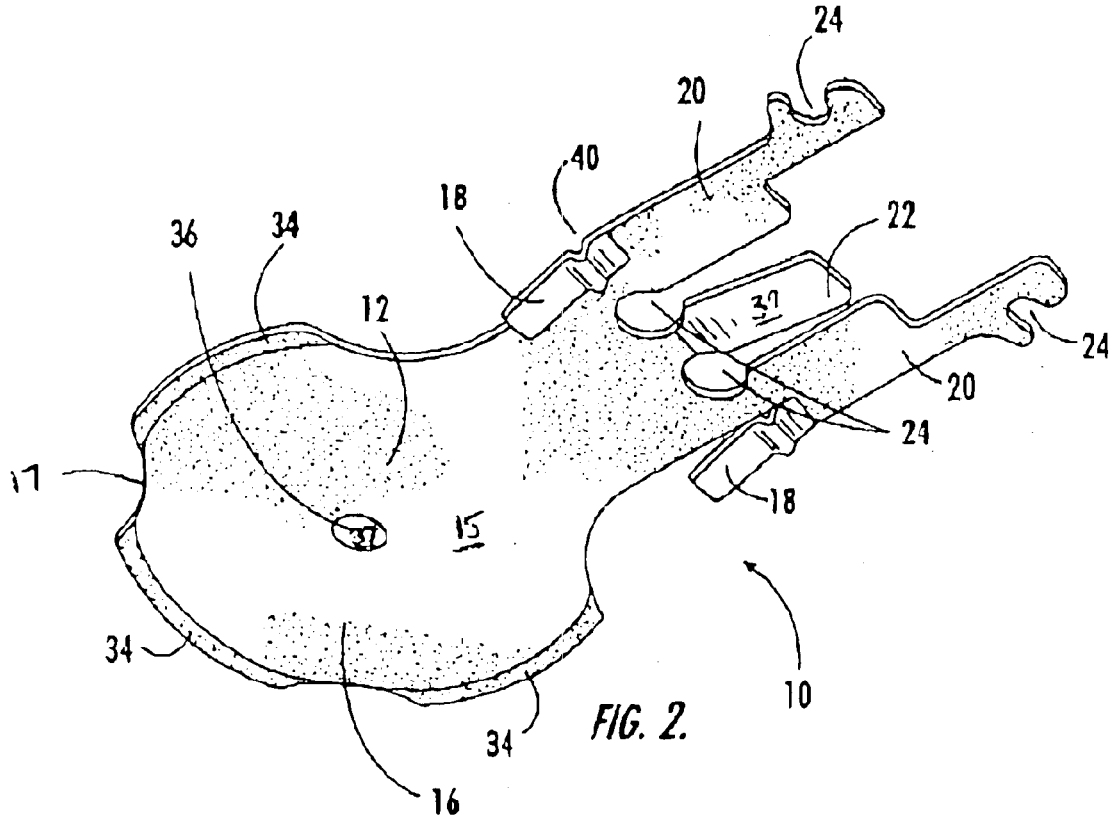
FIG. 2 is a perspective view of the bottom thereof.
Figure 3:
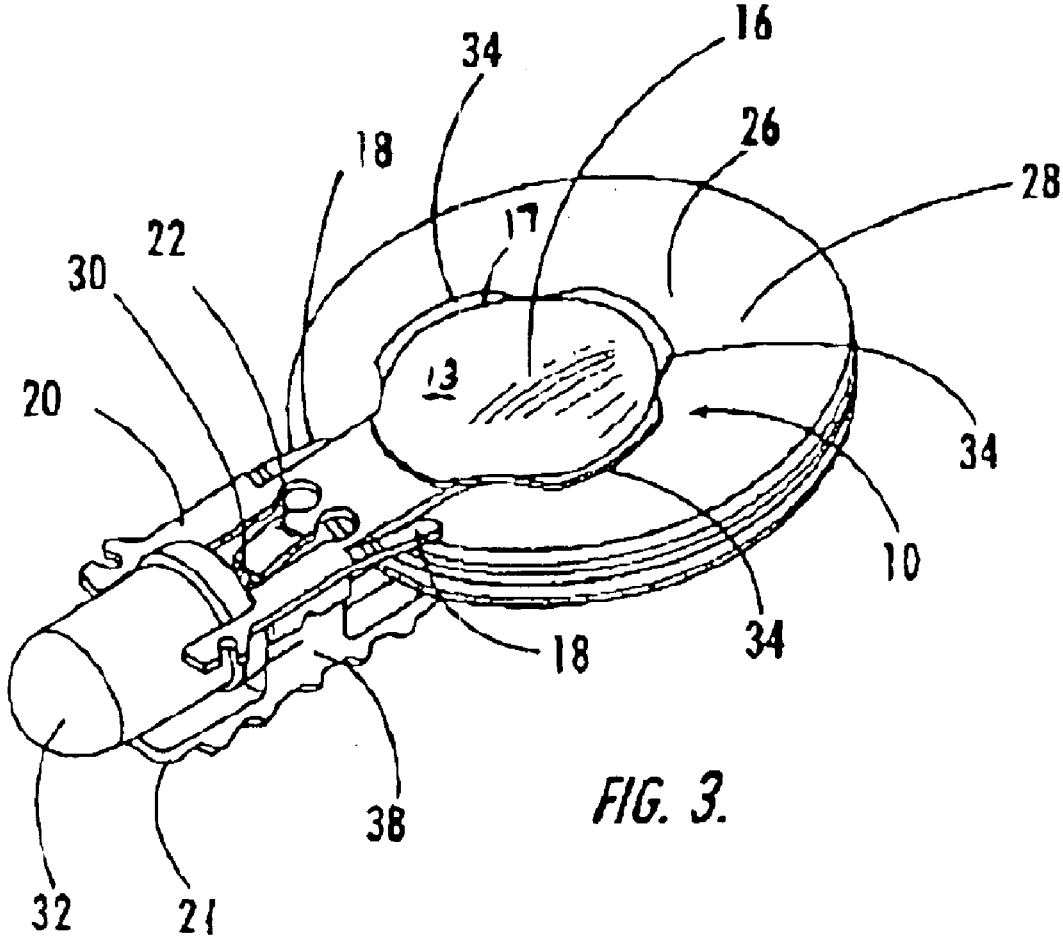
FIG. 3 is a perspective view of the present invention in a flashlight assembly.

Turning to FIGS. 1–3, the dome contact 10 is stamped from a thin sheet or strip of spring metal 14 so as to have spring biased contact portions. More specifically, the dome contact 10 is formed having four distinct portions, including a dome section 16, auxiliary contacts 18, retaining arms 20 and a contact clip 22. The retaining arms 20 include notches 24 to receive posts (not shown) located in the housing of the device into which the dome switch 10 is installed. The notches 24 hold the dome contact 10 firmly in place in operable relation to the device. Auxiliary contacts 18 are bent downwardly, so as to be normally spring biased to contact the upper surface 26 of a battery 28 in their normal resting position (see FIG. 3). The contact clip 22 is also bent slightly downward to exert constant pressure and maintain contact with the upper contact lead 30 of LED 32.

The dome contact 10 of the present invention is formed generally out of a metallic, electrically conductive material such as a thin sheet of stainless steel. The specific material chosen is selected for its material properties such as conductivity and resiliency, both of which impact upon the operation of the finished contact 10. The dome portion 16 of the contact 10 has an inner surface 15, an outer surface 13 and is formed into a convex shape that curves upwardly in a spherical profile. Further, the dome portion 16 includes flat tabs 34 around the outer peripheral edge 17 that serve to stabilize the dome 16 and maintain its position relative to the assembly during operation of the contact 10.

In the configuration as shown in FIG. 3, the dome contact 10 is seated on top of the surface terminal 26 of battery 28. To insulate the inner surface 15 of the dome portion 16 of the dome contact 10 from the upper surface 26 of the battery 28, thus maintaining a normally off switch position, the inner surface 15 of the dome 10 is selectively covered with a non-conductive coating. In particular, the flat tabs 34 located at the outer peripheral edges 17 of the dome portion 16 that actually rest on the upper surface 26 of the battery 28 include the non-conductive coating 12 to prevent electricity from normally being conducted through the dome 10 when it is seated in contact with the upper surface 26 of the battery 28. Referring back to FIG. 2, a small portion of the non-conductive coating 12 is missing, forming a void 37 near the center 36 inner surface 15 of the dome portion 16 of the contact 10 to allow the center of the dome 36, when depressed, to make electrical contact with the upper surface 26 of the battery 28 to complete the circuit. Still referring to FIG. 2, the non-conductive coating 12 is also missing from the contact clip 22, forming an additional void 39 which allows the contact clip to be in electrical communication with the lead wire 30 from the LED 32. As can be understood, in its resting position, the dome portion 16 of the contact 10 is biased in an upwardly curved manner, maintaining the center 36 of the dome portion 16 in spaced relation to the surface 26 of the battery 28. When depressed, the center 36 of the dome 16 is flexed until the un insulated center 36 contacts the battery 28. In this regard, the contact 10 makes electrical contact through the void 37 provided in the non-conductive coating 12.

The dome contact 10 shown in this present embodiment also includes auxiliary contact arms 18 that provide a constant on actuator function. Slide actuator 21 is installed so as to be slideably operable in the bottom of the device housing (not shown). The slide actuator 21 has cam surfaces 38 that exert a force on auxiliary contacts 18. When the slide actuator 21 is in its rearmost position, the cam surfaces 38 hold auxiliary contacts 18 up and out of electrical contact with the upper surface 26 of the top battery 28. When the slide actuator 21 is in its forward most position, auxiliary contacts 18 drop down onto the upper surface 26 of the battery 28 thereby energizing the device. The auxiliary contacts 18 include a small ridge 40 that engages with a channel in the cam surface 38 of the slide actuator 21. The ridge 40 retains the slide 20 in the rear most position with the flashlight off until the user intentionally exerts a force on the slide actuator 21 to energize the light.

The accurate placement of the insulation 12 on the bottom surface of the dome contact 10 of the present invention is critical to the proper functioning of the device into which the dome contact 10 is installed. As can be seen, the present invention provides a compact switch mechanism that is installed in close proximity to several electrical components within the electronic device and is generally installed in intimate contact with one contact of a battery 28. Therefore, the proper placement of the insulation 12 is required to prevent the contact 10 from making unintentional contact with the battery 28 causing the circuit to be undesirably energized. The method of manufacturing the present invention provides for accurate placement of the insulation as an integral step in the forming and manufacture of the dome contact 10.

Figure 4:
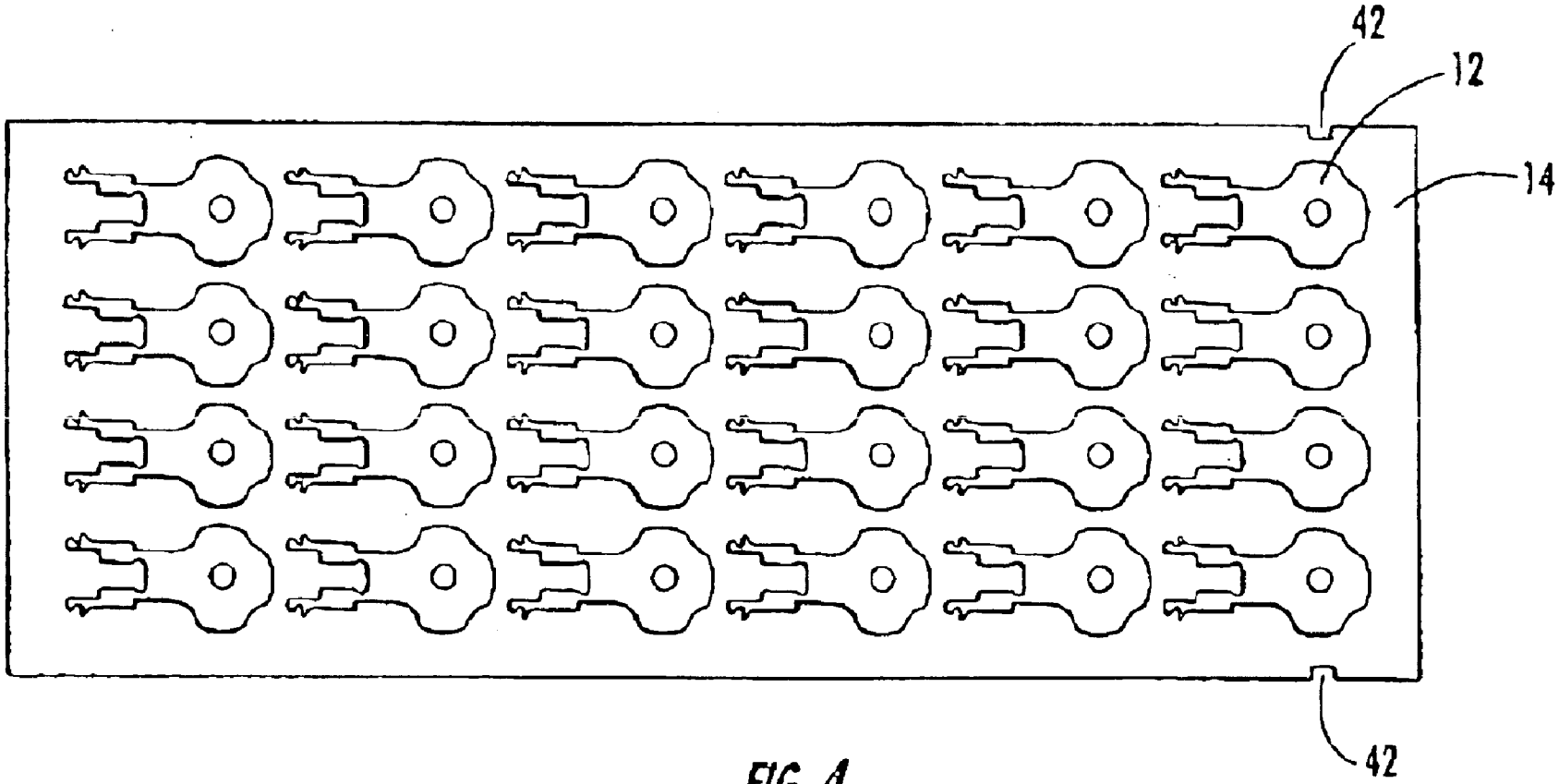
FIG. 4 is a top view of the sheet feedstock with the insulation applied before stamping.

Turning to FIG. 4, a sheet of metallic feedstock 14 material as used in forming the dome contact 10 of the present invention is shown. In manufacturing the selectively insulated dome contact 10, a sheet of insulative material 12 having a preapplied pressure sensitive adhesive coating is die cut to form the desired shape of the insulation 12, as it will appear on the bottom surface of the dome contact 10. The insulative material 12 may be a variety of materials known in the art to be dielectric such as Mylar or elastomeric rubber and may take the form of a tape with preapplied adhesive or a sheet to which an adhesive is applied. These die cut shapes are then applied onto the sheet of metallic feedstock 14 in registration with alignment marks 42 on the metallic sheet. It is important in the present invention that the die cut shapes 12 are precisely placed onto the sheet 14 so that the insulative material 12 is in proper registration with the stamping machine and is located in the proper position on the finished dome contact 10.

Once the insulative material 12 is applied to the sheet 14, the sheet 14 is cooled to a temperature near freezing. The cooling process reduces the pliability of the insulative material 12 and the adhesive. This step is important because if the material is not cooled, as the sheet 14 of material with the applied insulative layer 12 is passed into the next fabrication step, the insulative material 12 and adhesive tend to stick to the stamping blades causing the machine to become gummed up. When the insulative material 12 and adhesive is cooled, the reduced pliability causes the material 12 to be brittle and reduces its ability to stick to the cutting blades.

After the cooling step, the sheet 14 of feedstock is placed into the forming and stamping press. The registration marks 42 on the sheet 14 allow the sheet 14 to be placed in precise registration with the stamp head of the machine to ensure that stamp cuts the dome contact 10 from the precise locations where the insulative material 12 has been placed. The dome 16 is then formed and the dome contact 10 is stamped to free it from the feedstock 14 material thereby producing the finished product.

It can therefore be seen that the instant invention provides a novel selectively insulated dome contact 10 that has an integrally formed insulative layer 12. Further, the present invention provides a method of manufacturing a selectively insulated dome contact 10 for incorporation into compact low cost electronics components. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A resilient selectively insulated contact assembly comprising:

a movable contact member having an movable dome shaped portion, said contact member being formed from a thin elastic metal plate, said contact member having an outer surface, an inner surface and a peripheral edge;

an insulative layer adhered to said inner surface of said contact member and extending at least partially into and adhered to an inner surface of said dome shaped portion, said insulative layer having selective voids at predetermined locations.

2. The resilient selectvely insulated contact assembly of claim 1, wherein said insulative layer is a non-conductive film having an adhesive backing.

3. The resilient selectively insulated contact assembly of claim 2, wherein said insulative layer is die-cut to a predetermined shape to include said voids prior to adhering said layer to said contact member.

4. The resilient selectively insulated contact assembly of claim 1, wherein said voids include one void on the inner surface of said dome near the center of said dome.

5. The resilient selectively insulated contact assembly of claim 1, further comprising:

at least one contact arm connected to said peripheral edge of said contact member; and at least one stabilizer arm connected to said peripheral edge of said contact member.

6. The resilient selectively insulated contact assembly of claim 5, wherein said voids include one void on the inner surface of said dome near the center of said dome and another void on said at least one contact arm.

7. A circuit assembly comprising:

a light emitting diode having a first contact leg and a second contact leg;

a battery having a first contact surface and a second contact surface, wherein said first contact surface is in electrical communication with said first contact leg of said light emitting diode;

a movable contact member having an movable dome shaped portion, said contact member being formed from a thin elastic metal plate, said contact member having an outer surface, an inner surface and a peripheral edge, said inner surface being adjacent and in spaced relation to said second contact surface of said battery and said outer surface being in electrical communication with said second contact leg of said light emitting diode;

an insulative layer adhered to said inner surface of said contact member and extending at least partially into and adhered to an inner surface of said dome shaped portion, said insulative layer residing between said contact member and said second contact surface of said battery, said insulative layer having selective voids at predetermined locations, said voids in said insulative layer allowing said contact member to make electrical contact with said second contact surface of said battery upon being depressed thereby energizing said circuit.

8. The circuit assembly of claim 7, wherein said insulative layer is a non-conductive film having an adhesive backing.

9. The circuit assembly of claim 8, wherein said insulative layer is die-cut to a predetermined shape to include said voids prior to adhering said layer to said contact member.

10. The circuit assembly of claim 7, wherein said voids include one void on the inner surface of said dome near the center of said dome.

11. The circuit assembly of claim 7, further comprising:

at least one contact arm connected to said peripheral edge of said contact member, wherein said contact arm is disposed between said contact member and said second contact leg of said LED; and at least one stabilizer arm connected to said peripheral edge of said contact member.

12. The circuit assembly of claim 11, wherein said voids include one void on the inner surface of said dome near the center of said dome and another void on said at least one contact arm.

* * * * *